US005752415A

United States Patent [19]

Tsai

[11] Patent Number: 5,752,415

[45] Date of Patent: May 19, 1998

[54] RETRACTING HANDLE BAR

[76] Inventor: Cheng-Hsien Tsai, No. 103, Da-Ming I Road, Tien-Tzu Hsiang, Taichung Hsien, Taiwan

[21] Appl. No.: 729,374

[22] Filed: Oct. 17, 1996

[51] Int. Cl.[6] ..... B25G 1/04

[52] U.S. Cl. ..... 74/527; 403/109; 16/115

[58] Field of Search ..... 74/527; 280/655, 280/655.1, 47.315, 47.371; 403/109, 329, 321, 325; 16/115

[56] References Cited

U.S. PATENT DOCUMENTS

| | | | |
|---|---|---|---|
| 2,427,841 | 9/1947 | Dichter | 403/109 |
| 4,256,320 | 3/1981 | Hager | 16/115 X |
| 5,519,919 | 5/1996 | Lee | 280/655 X |

FOREIGN PATENT DOCUMENTS

| | | | |
|---|---|---|---|
| 3013031 | 10/1981 | Germany | 280/655.1 |

*Primary Examiner*—Charles A Marmor
*Assistant Examiner*—Mary Ann Battista
*Attorney, Agent, or Firm*—Jacobson, Price, Holman & Stern, PLLC

[57] ABSTRACT

A retracting handle bar including a plurality of tubes that slide one inside another, a plurality of lock devices for locking the tubes in the extended position, and a press bar for unlocking the lock devices, wherein: each of the lock devices includes an axial member mounted in one end of an antecedent tube, a retainer strip pivoted to the axial member, and a socket mounted around the retainer strip and the axial member, the axial member having a body with a taper hole at one end, and an extension rod at an opposite end, the body of the axial member being inserted into a second tube, the axial extension rod of the axial member being inserted into the antecedent tube, the retainer strip having a fixed end pivoted to the axial extension rod of the axial member inside the antecedent tube, and a free end disposed inside the antecedent tube, the free end of the retainer rod having a raised portion forced into engagement with a locating hole in the antecedent tube, the socket being disposed inside the second tube, having an inner diameter smaller than the outer diameter of the body of the axial member, and at least one axial spring arm, each of the at least one axial spring arm having a raised portion at an outer side forced into engagement with one locating hole in the second tube; when the press bar is depressed, the retainer strip of each lock devices is disengaged from the corresponding tube, permitting the retracting handle bar to be collapsed.

4 Claims, 8 Drawing Sheets

RETRACTING HANDLE BAR

BACKGROUND OF THE INVENTION

The present invention relates to retracting handle bars, and relates more particularly to such a retracting handle bar which is easy to manufacture and to assemble, and which can be positively set between the extended condition and the collapsed condition.

In a regular retracting handle bar, the outer tube has a longitudinal dent and a locating hole in the longitudinal dent; the inner tube has a longitudinal groove engaged with the longitudinal dent of the outer tube, a springy strip with a raised portion suspending in the longitudinal groove. When the inner tube is extended out of the outer tube, the raised portion of the springy strip is forced into the locating hole of the outer tube, and therefore the inner tube is locked in the extended position. When to collapse the inner tube, the raised portion of the springy strip must be forced inwards from the locating hole of the outer tube by hand so that the inner tube can be moved back to the inside of the outer tube. However, the fingers tend to be injured when pushing the raised portion of the springy strip away from the locating hole of the outer tube and forcing the inner tube back to the inside of the outer tube.

SUMMARY OF THE INVENTION

The present invention has been accomplished to provide a retracting handle bar which eliminates the aforesaid problem. According to the present invention, the retracting handle bar comprises a plurality of tubes that slide one inside another, a plurality of lock means for locking the tubes in the extended position, and a press bar for unlocking the lock means, wherein: each of the lock means includes an axial member mounted in one end of a first tube, a retainer strip pivoted to the axial member, and a socket within a second tube, the axial member having a body with a taper hole at one end, and an extension rod at an opposite end, the body of the axial member being inserted into the second tube, the axial extension rod of the axial member being inserted into the first tube, the retainer strip having a fixed end pivoted to the axial extension rod of the axial member inside the first tube, the free end of the retainer strip having a raised portion forced into engagement with a first locating hole in the first tube, the socket being disposed inside the second tube, having an inner diameter smaller than the outer diameter of the body of the axial member, and at least one axial spring arm, each of the at least one axial spring arm having a raised portion at an outer side forced into engagement with one second locating hole in the second tube; when the press bar is depressed, the retainer strip is forced by the press bar to release its raised portion from the antecedent tube for permitting the first tube to be inserted into the second tube, so that the taper hole of the body of the axial member which is connected to the first tube is forced against the retainer strip of the lock means in the second tube, causing the raised portion of the retainer strip of the lock means in the second tube to be disengaged from the second tube, permitting the first tube to be received inside the second tube.

DETAILED DESCRIPTION OF THE PREFERRED EMBODIMENT

Figure 1:
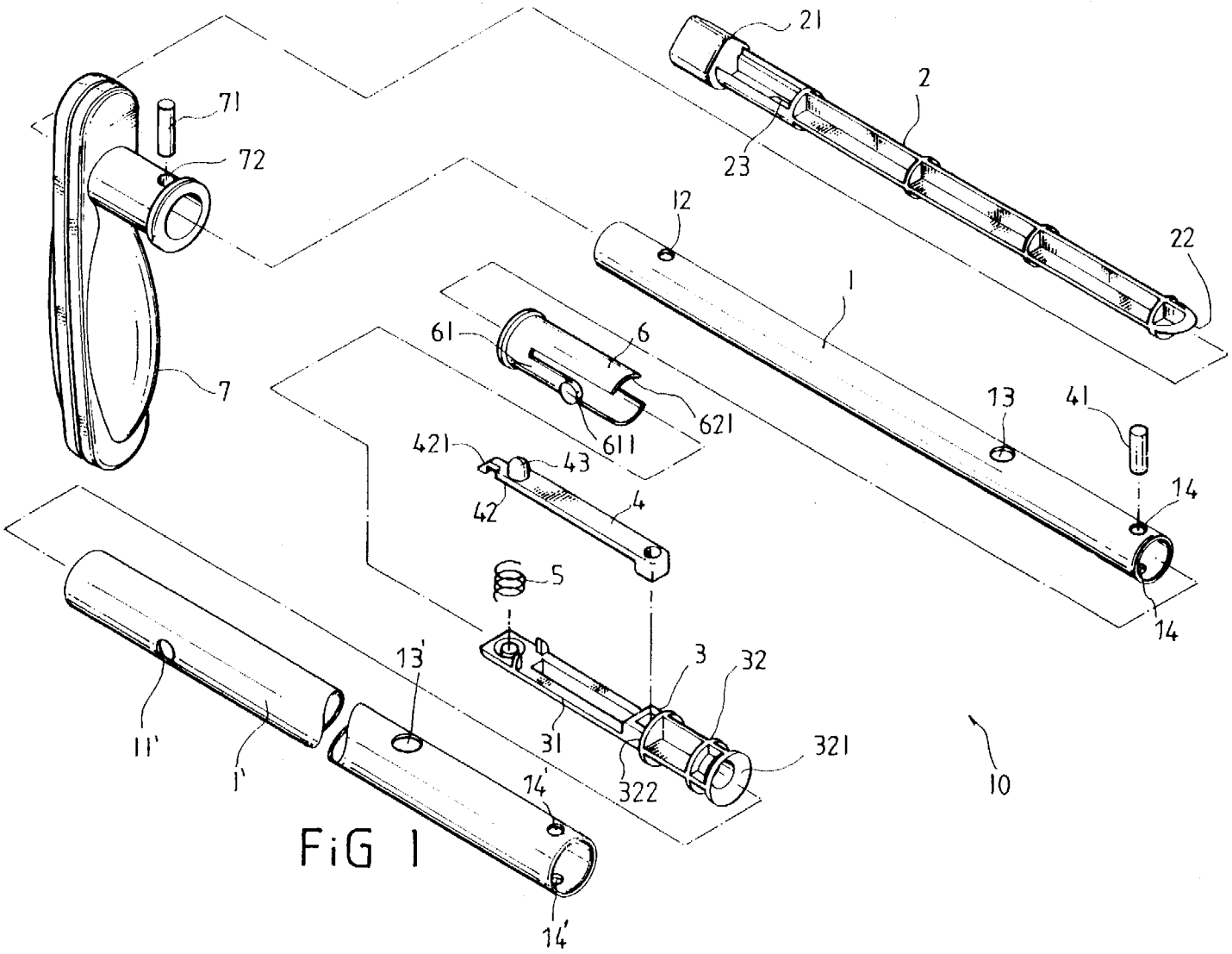
FIG. 1 is an exploded view of a retracting handle bar according to the present invention.
Figure 4:
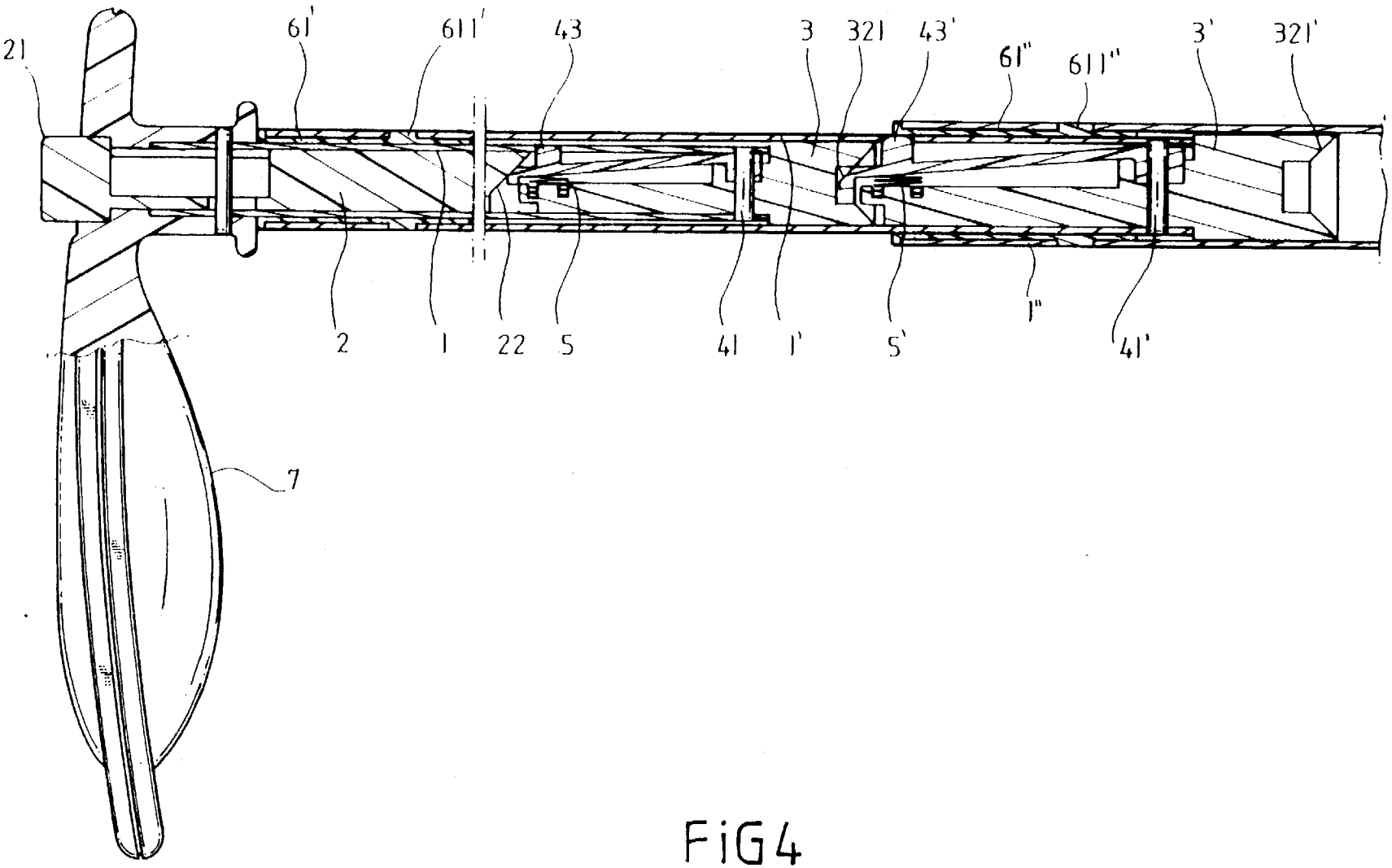
FIG. 4 is another sectional view of the present invention, showing the interaction between the axial member and the retainer strip.
Figure 5:
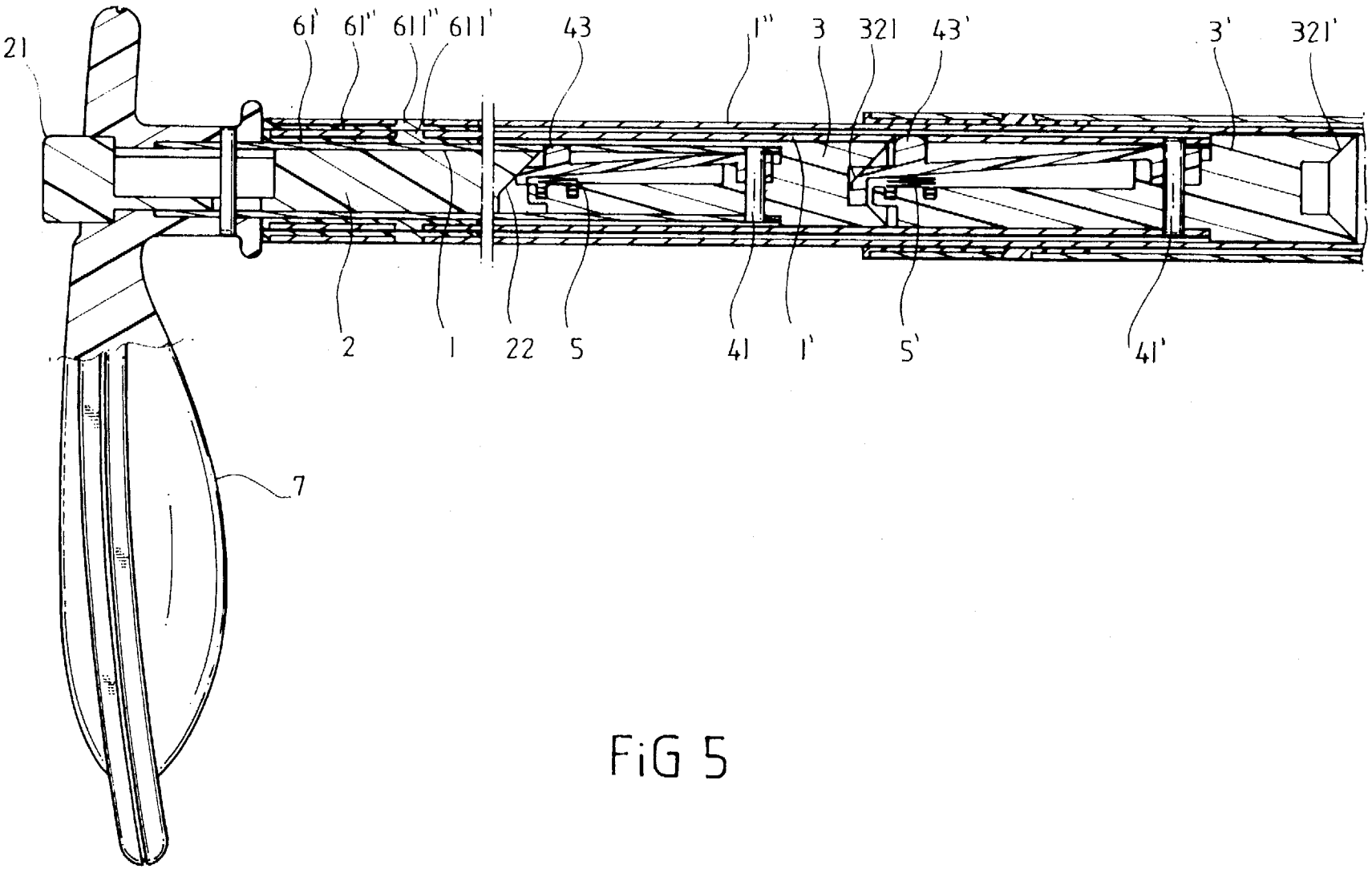
FIG. 5 is another sectional view of the present invention, showing the retracting handle bar collapsed.
Figure 6:
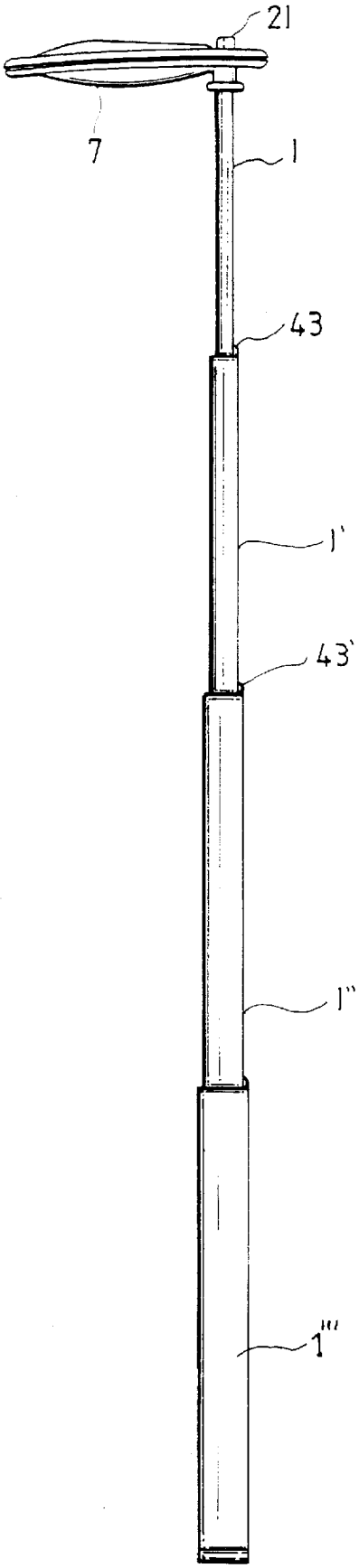
FIG. 6 is an applied view of the present invention, showing the retracting handle bar used as a walking stick; and, FIG. 7 is another applied view of the present invention, showing the retracting handle bar used in a travel bag.

Referring to FIGS. 1 and 4, a retracting handle bar 10 in accordance with the present invention, is comprised of a plurality of tubes of different diameters that slide one inside another. The number of the tubes is determined subject to actual requirements, the intermediate tubes between the first and last tubes have the same structure and same attached elements except the difference in diameter. The last tube uses like elements in the other tubes (except the difference of having a relatively bigger diameter). In FIG. 4, reference number 1 designates the first tube, 1' designates the second tube, 1" designates the third tube, 1'" designates the fourth tube, and like elements in like tubes are referenced by like reference numbers with the exception of the superscript sign of single prime for elements in the second tube, double prime for elements in the third tube, triple prime for elements in the fourth tube, etc., for example, the hereinafter described sockets which are respectively mounted in the second tube, the third tube and the fourth tube, are referenced by 6', 6" and 6'" respectively. The reference numbers for the elements in the first tube are not added with any superscript sign, for example, the axial member in the first tube is referenced by 3, the axial member in the second tube is referenced by 3', the axial member in the third tube is referenced by 3", and so on. The other elements are referenced by respective reference numbers in the same manner. 5 Although the reference numbers for the elements in the second tube are marked with the superscript sign of "", the body of the axial member 3 of the first tube 1 which is inserted into the second tube 1' is still referenced by 32 without the superscript sign of "", the body of the axial member 3' of the second tube 1' which is inserted into the third tube 1"is referenced by 1', the body of the axial member 3" of the third tube 1" which is inserted into the fourth tube 1'" is referenced by 32'.

Referring to FIG. 1, a press bar 2 is inserted into one tube, namely, the first tube 1, having one end terminating in a press head 21 which disposed outside the first tube 1, and an opposite end terminating in a bevel edge 22. An axial member 3 is mounted in one end of the first tube 1 opposing to the press bar 2. The axial member 3 has an axial extension rod 31 at one end inserted into the first tube 1. A retainer strip 4 is pivoted to the axial extension rod 31 of the axial member 3 and disposed inside the first tube 1. The retainer strip 4 and the axial extension rod 31 of the axial member 3 are secured to the inside of the first tube 1 by a pivot 41, which is mounted in a transverse through hole 14 in the first tube 1. The retainer strip 4 has a bevel edge 421 formed in the free end 42 thereof and facing the bevel edge 22 of the press bar 2, and a raised portion 43 projecting out of the first tube 1 through a first hole 13 thereof. A spring 5 is supported between the axial extension rod 31 of the axial member 3 and the free end 42 of the retainer strip 4. The body 32 of the axial member 3 is disposed outside the first tube 1, having an outer diameter bigger than the outer diameter of the first tube 1, and an axial taper hole 321 at one end remote from the axial extension rod 31. Shoulder 322 separates the body 32 form the axial extension rod 31. A socket 6 is revolvably sleeved onto the axial extension rod 31 of the axial member 3 and the retainer strip 4, and retained between the body 32 of the axial member 3 and the raised portion 43 of the retainer strip 4, having two axial spring arms 61, each having an end 621 and at least one, for example, two raised portions 611 respectively raised from the axial spring arms 61.

Figure 2:
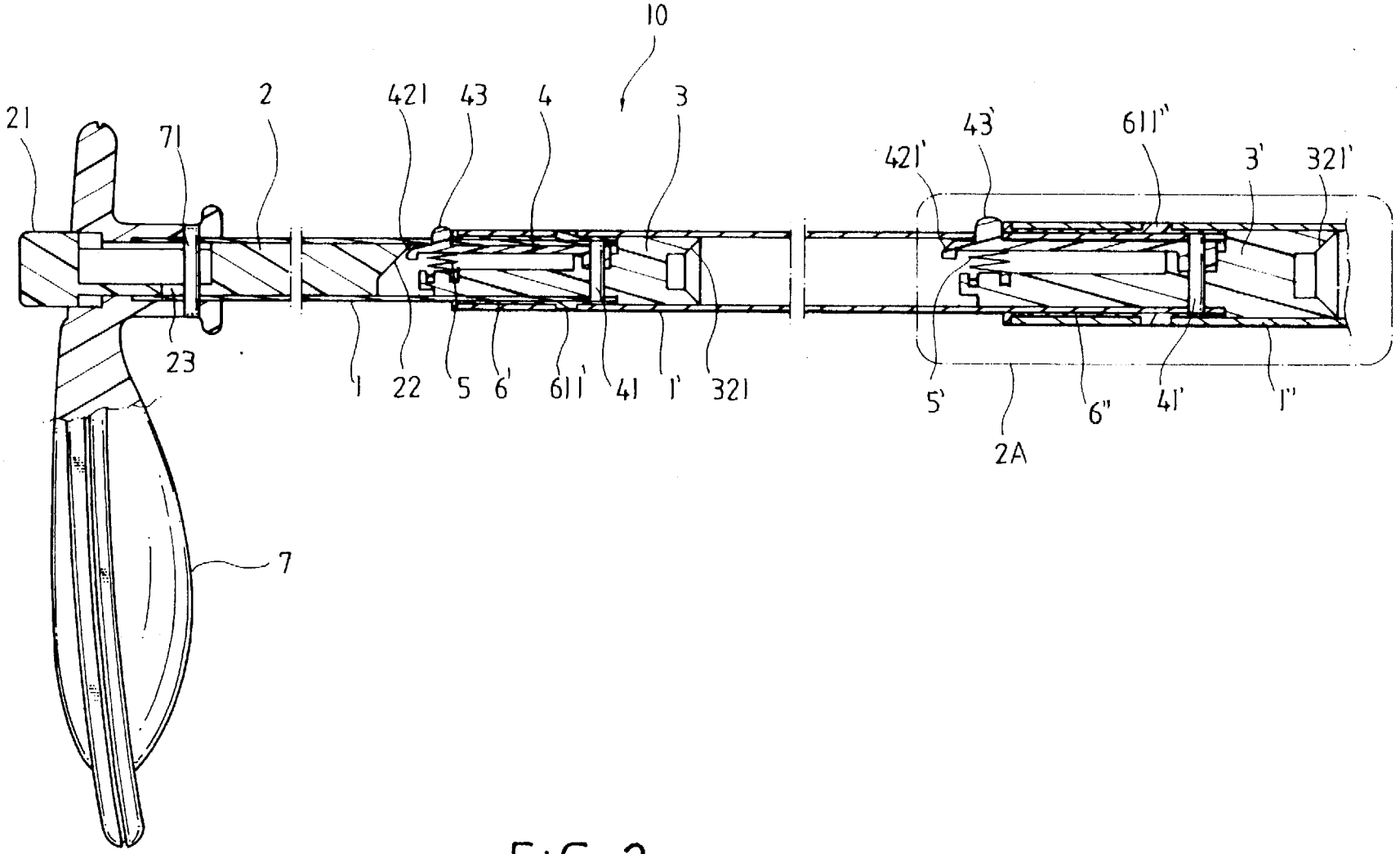
FIG. 2 is a sectional assembly view of the retracting handle bar shown in FIG. 1.
Figure 2A:
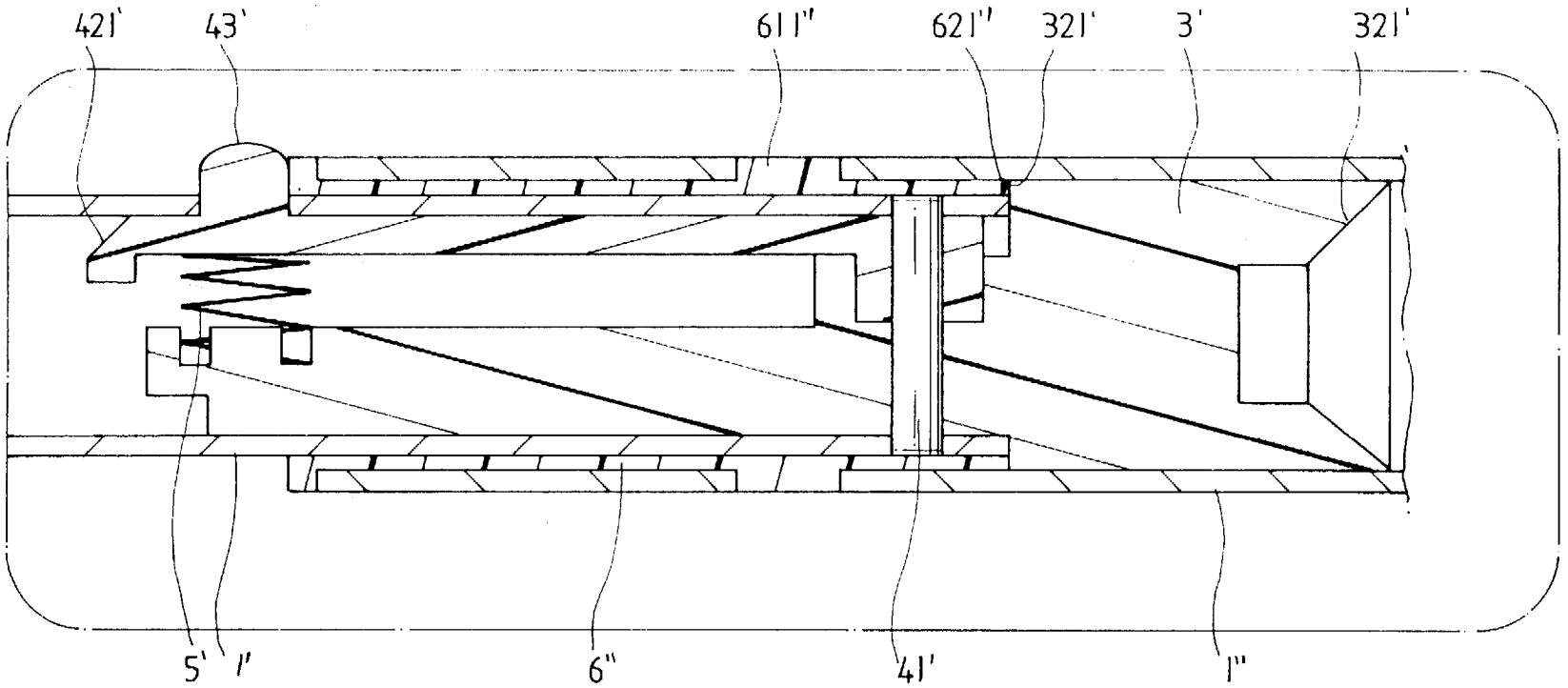
FIG. 2A is an enlarged view of part 2A of FIG. 2, showing the position of the socket.
Figure 3:
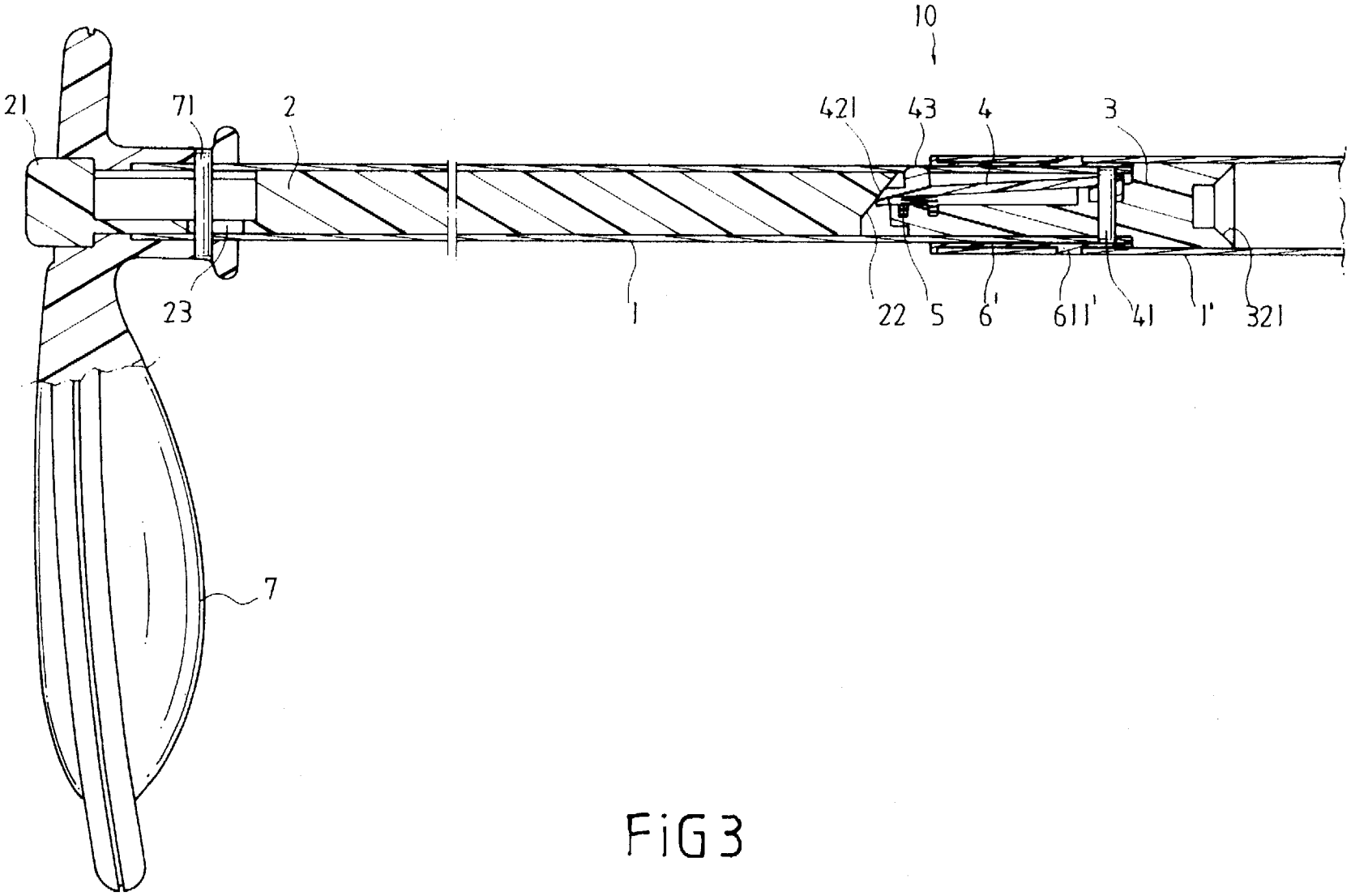
FIG. 3 is another sectional view of the present invention, showing the retracting handle bar collapsed.

FIGS. 2, 3 and 4 show the present invention used in a walking stick. As illustrated, a hand grip 7 and the press bar 2 are fastened to the first tube 1 at one end by inserting a pin 71 through a hole 72 in the hand grip 7, a hole 12 in the first tube 1 at one end remote from the pivot 41, and an elongated slot 23 in the press bar 2; the press head 21 of the press bar 2 projects out of the hand grip 7; the first tube 1 and the axial member 3 are inserted into a second tube 1', permitting the raised portions 611 of the spring arms 61 of the socket 6 to be respectively forced by the spring force of the spring arms 61 into engagement with a respective radial locating hole 11' in the second tube 1'. Because the elongated slot 23 of the press bar 2 is loosely coupled to the pivot 71, the press bar 2 can be axially moved in the first tube 1 within a distance subject to the length of the elongated slot 23.

Referring to FIGS. 1 and 3 again, when to collapse the retracting handle bar 10, the press head 21 of the press bar 2 is depressed to force the bevel edge 22 of the press bar 2 against the bevel edge 421 of the free end 42 of the retainer strip 4, causing the raised portion 43 of the retainer strip 4 to be forced inwards and disengaged from the first tube 1, for permitting the first tube 1 to be inserted into the inside of the second tube 1'. When the first tube 1 is collapsed and received in the second tube 1', the taper hole 321 of the body 32 of the axial member 3 is stopped at the retainer strip 4' inside the second tube 1'. When the press head 21 of the press bar 2 is continuously depressed after the first tube 1 is collapsed and received inside the second tube 1', the free end 42' of the retainer strip 4' will be forced into the taper hole 321 of the body 32 of the axial member 3, causing the raised portion 43' of the retainer strip 4' to be disengaged from the second tube 1' and received inside the second tube 1', for permitting the second tube 1' to be forced into the inside of the third tube 1". Therefore, by means of the aforesaid procedure, the tubes 1, 1', 1"of the retracting handle bar 10 are collapsed and received one inside another.

Referring to FIG. 4, when the hand grip 7 is pulled outwards from the tubes 1, 1', 1", the tubes 1, 1', 1" are respectively extended out from one another. When the first tube 1 is extended out the second tube 1', the respective retainer strip 4 is forced by the respective spring 5 to force the respective raised portion 43 into engagement with the first tube 1, and at the same time the raised portions 611 of the spring arms 61 of the socket 6 are respectively forced into engagement with the locating holes 11' of the second tube 1'. Because the outer diameter of the body 32 of the axial member 3 is bigger than the inner diameter of the socket 6, the first tube 1 is retained in the extended position and stopped from being moved axially relative to the second tube 1'. In the same manner, the other tubes 1', 1" are respectively retained in the extended position.

Figure 7:
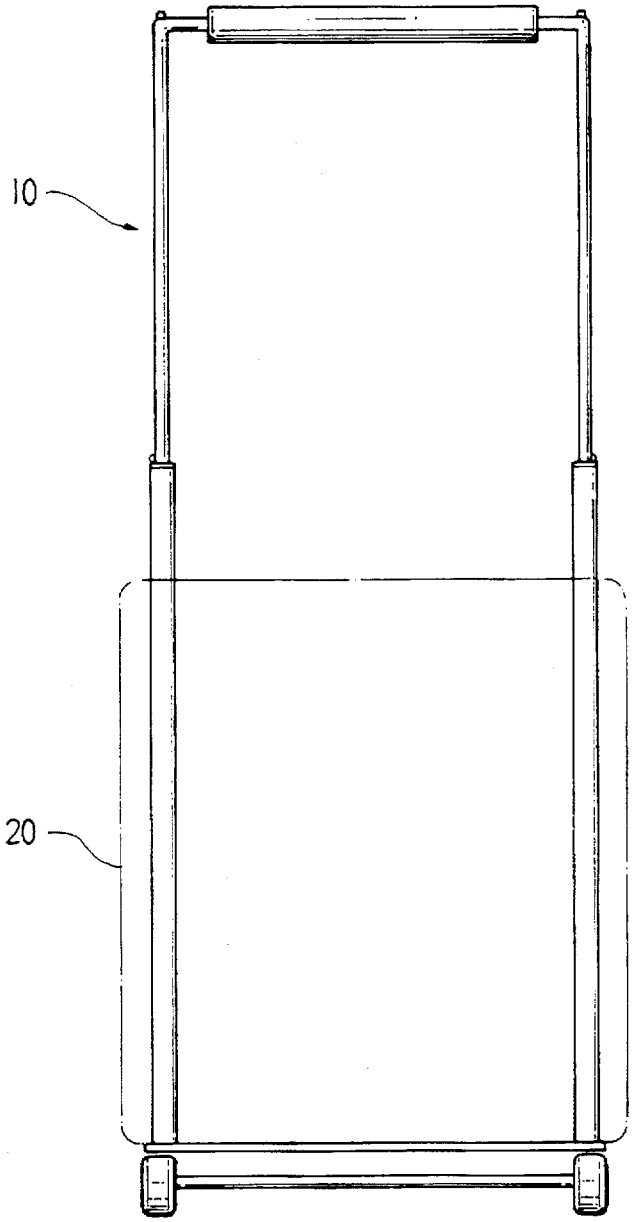

FIG. 7 shows another application example of the present invention in which the retracting handle bar 10 is installed in a travel bag 20.

As indicated, the present invention provides a retracting handle bar 10 which has a simple structure that can be conveniently manufactured and assembled, and which can be positively set between the extended condition and the collapsed condition.

It is to be understood that the drawings are designed for purposes of illustration only, and are not intended as a definition of the limits and scope of the invention disclosed.

What the invention claimed is:

1. A retracting handle bar comprising a plurality of tubes that slide one inside another, a press bar mounted in one of said tubes and controlled to release said tubes for permitting them to be collapsed and received inside one another, a plurality of lock means respectively mounted in said tubes for locking said tubes in an extended position, wherein:

each of said lock means comprises an axial member mounted in one end of a first of said tubes, a retainer strip pivoted to said axial member, and a socket mounted in a second of said tubes, said axial member comprising a body having a taper hole at one end and an axial extension rod at an opposite end, the body of said axial member being inserted into the second tube, the axial extension rod of said axial member being inserted into the first tube, said retainer strip having a fixed end pivoted to the axial extension rod of said axial member inside the first tube, and a free end disposed inside the first tube, the free end of said retainer strip having a raised portion forced into engagement with a locating hole in the first tube, said socket being disposed inside an second tube, having an inner diameter smaller than an outer diameter of the body of said axial member, and at least one axial spring arm, each of said at least one axial spring arm having a raised portion at an outer side forced into engagement with one locating hole in the second tube; when said press bar is depressed, said retainer strip is forced by said press bar to release the raised portion from the first tube for permitting the first tube to be inserted into the second tube, so that the taper hole of the body of the axial member which is connected to the first tube is forced against the retainer strip of the lock means in the second tube, causing the raised portion of the retainer strip of the lock means in the second tube to be disengaged from the second tube, permitting the second tube to be received inside a third of said tubes.

2. The retracting handle bar of claim 1 wherein said press bar has a press head extending out of said first tube, and a bevel edge disposed inside said first tube adapted for forcing the retainer strip of the lock means in said first tube away from engagement with said first tube.

3. The retracting handle bar of claim 2 wherein the retainer strip of each of said lock means has a bevel edge adapted for acting against the bevel edge of said press bar or the taper hole of the body of the axial member of another of said lock means.

4. The retracting handle bar of claim 1 wherein each of said lock means further comprises a spring element retained between the axial extension rod of the respective axial member and the respective retainer strip to impart an outer pressure to the respective retainer strip, causing the raised portion of the respective retainer strip to be forced into engagement with the corresponding tube.

* * * * *